United States Patent [19]

Breudigam

[11] 3,989,621

[45] Nov. 2, 1976

[54] VIBRATORY SCREENER

[75] Inventor: Richard L. Breudigam, Fairview Park, Ohio

[73] Assignee: The Cleveland Vibrator Company, Cleveland, Ohio

[22] Filed: June 14, 1974

[21] Appl. No.: 479,373

[52] U.S. Cl. ..... 209/326; 209/365 B; 209/366.5

[51] Int. Cl.[2] ..... B07B 1/34; B07B 1/42

[58] Field of Search ..... 209/325, 326, 346, 366, 209/366.5, 367, 332, 365 B, 329, 415

[56] References Cited

UNITED STATES PATENTS

| | | | |
|---|---|---|---|
| 1,565,883 | 12/1925 | Adrainson et al. | 209/326 |
| 1,685,940 | 10/1928 | Deister | 209/346 |
| 1,882,908 | 10/1932 | Reynolds | 209/346 |
| 1,903,775 | 4/1933 | Christopher | 209/365 B |
| 1,929,249 | 10/1933 | Lippman | 209/326 |
| 2,259,942 | 10/1941 | Stroud | 209/326 |
| 2,260,386 | 10/1941 | Krohn | 209/326 |
| 2,285,348 | 6/1942 | Morgan | 209/365 B |
| 2,299,661 | 10/1942 | Symons | 209/415 |
| 2,570,035 | 10/1951 | Loughlin | 209/346 |
| 3,089,582 | 5/1963 | Musschoot et al. | 209/365 B |
| 3,468,418 | 9/1969 | Renner | 209/326 |

FOREIGN PATENTS OR APPLICATIONS

| | | | |
|---|---|---|---|
| 787,205 | 9/1935 | France | 209/325 |

*Primary Examiner*—Frank W. Lutter
*Assistant Examiner*—Gregory N. Clements
*Attorney, Agent, or Firm*—Baldwin, Egan, Walling & Fetzer

[57] ABSTRACT

The vibratory screener presented is of a design to convert rotary vibration directly to an unsupported portion of a wire mesh or perforated plate screening surface, while imparting no vibratory energy to the screen's main supporting framework.

1 Claim, 3 Drawing Figures

VIBRATORY SCREENER

BACKGROUND OF THE INVENTION

Electromagnetic screen drives are known which utilize an electromagnetic drive unit directly connected to the wire screen cloth which is vibrated but these units are noisy and have to be tuned to a desired frequency, and the amplitude of the vibration produced is affected by varying loads on the screening surface because of the tuned vibration system. The present invention utilizes a motor driven mechanical vibrator which does not need to be tuned, and which is quieter than the electromagnetic screener and varying loads on the screening surface do not affect its amplitude of vibration, since it is not a tuned vibration system.

An object of the present invention is to provide a vibrating screener, using eccentrically mounted rotating weights, directly connected to the intermediate portion of the screening surface which produces a device which is quieter in operation than the electromagnetic screening apparatus, which requires no tuning, which transmits a full vibratory effect to the screen surface, which utilizes a unique isolation system, which requires very low maintenance, and which, in case of malfunction of the vibrator, permits replacement of the vibrator in 5 to 10 minutes.

Other objects and advantages of this invention will be apparent from the accompanying drawings and description and the essential features thereof will be set forth in the appended claims.

In the drawings,

FIG. 2 is a top plan view of FIG. 1; while

Figure 2:
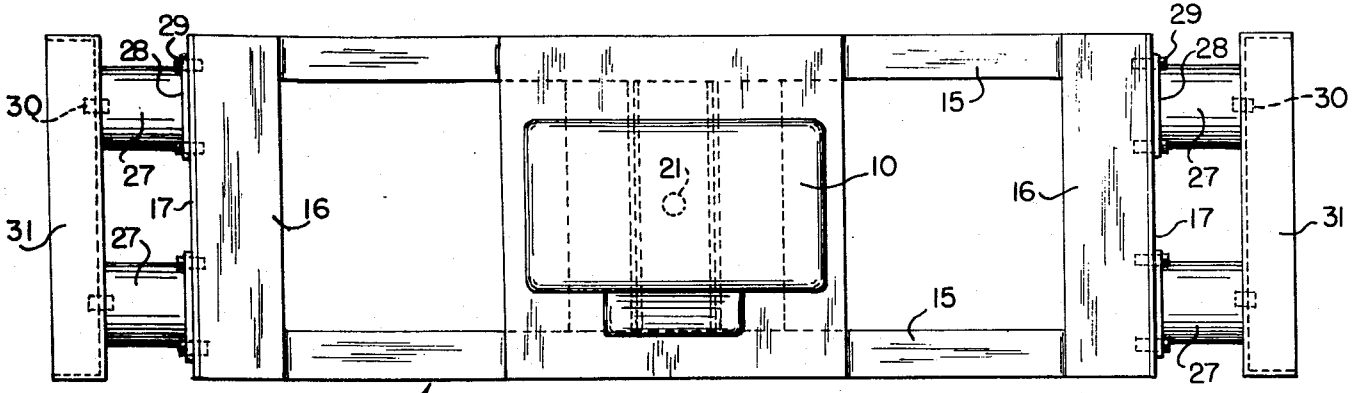

The embodiment shown in the drawings utilizes a motor driven mechanical vibrator having eccentrically mounted rotating weights driven by an electric motor inside the minimal unit 10 of the assignee of this application, The Cleveland Vibrator Company, of 2828 Clinton Avenue, Cleveland, Ohio 4413. The invention, however, is not limited to this style of rotary. The vibrator has a base 10*a* which is shown secured in an adapter bracket 11 by means of one or more screws 12. The adapter bracket is rigidly secured to one or more plates 13 which in turn are rigidly attached to a cross beam welded channel assembly 14. This assembly may be varied to suit specific conditions but is here shown as involving two parallel spaced longitudinally extending channels 15 having their open sides facing each other and rigidly connected by cross plates 16 and by the lowermost plate 13, also by end plates 17 and a central rigid connection involving two parallel vertical plates 18 which are welded at the top to cross angles 19 which in turn are welded to plate 13, and the parts 18 connected at the bottom by being welded to a plate 20 which in turn is welded to the flanges of the channels 15.

Centrally of the plate 20 is rigidly attached a driving stud 21 to which is attached rigidly a screen deck attachment bracket 22 by means of adjustable nuts 23. At its lower end, the attachment bracket 22 has flanges 22*a* which abut the top of the screening surface 24, and then a plate 25 is rigidly attached to the flange 22*a* and to the screen by welds 26. This is a one-location attachment immediately below the bracket flanges 22*a* as clearly seen in FIGS. 1 and 3.

The amplitude of the vertical vibration of the screen deck 24 typically ranges from near zero to about ¼ inch maximum, depending upon the pre-tension placed on the screening surface, the type of the screening surface, and the force output of the vibrator mechanism. It will be understood that the screen 24 is supported by a stationary framework holding the side edges of the screen 24 in the usual manner found in this type of equipment. The motion of the vibrating stud 21 and the attachments 20, 22*a* and 25 is elliptical when used with the rotary type vibrator indicated at 10. The peak of the vertical amplitude is up to about ¼ inch as previously mentioned with an horizontal component, or parallel with the screening surface 24, which is about one-quarter to one-half of the vertical amplitude. This two-directional motion causes near screen-size particles to bounce and rotate as they move along the screening surface eliminating blinding or plugging of the screen openings, and increasing screening efficiency.

To isolate vibration of the assembly 14 as much as possible, at least four rubber-in-shear isolation mounts 27 are provided, two at each of the opposite horizontal ends of the assembly 14. More of these isolation mounts may be utilized where necessary. The mounts shown in the drawings are cylindrical in shape and are known in the trade as Lordco (trademark of Lord Manufacturing Company, Erie, Pennsylvania) sandwiches. The invention, however, is not limited to the use of these particular mounts but may use any suitable isolation type system. The inner end of each mount is secured to an attaching plate 28 by four bolts 29 and the outer end of each mount is secured by a central screw 30 to rigid rubber mount attaching brackets 31. These brackets preferably have spaced holes 31*a* in the bottom flange for attachment of the flange to the main framework (F) which supports the screen 24. It results from this resilient mounting that the assembly 14 is free to vibrate impelled by the vibrator 10 but the horizontal vibration is greatly dampened by the horizontal rigidity of the screen 24 and plates 25.

It should be understood that the vibrator 10 is supplied with electrical current from a suitable source and a load of the material to be screened is fed to the screening surface 24 in the usual manner. This device is very efficient for screening particles of 30 meshes per inch or smaller. The driving force of the vibrator 10 is combined with the weight of the main cross beam assembly 14, thus providing a sharp and positive screening motion. The combined weight of the vibrator 10 and the assembly 14 gives sufficient power to overcome heavy deck loads on the fine mesh screening surface 24. The elliptical action of the vibrator stud also causes faster movement of the fines to the screen surface, thus providing more accurate screen stratification.

The term "high frequency" used herein, both in the specification and claims, is intended to include a frequency of 1750 or higher, the highest common frequency being 3600 vibrations per minute. A frequency of 1750 is recommended for screening coarser particles while a frequency of about 3600 is recommended for fine particles.

Figure 3:
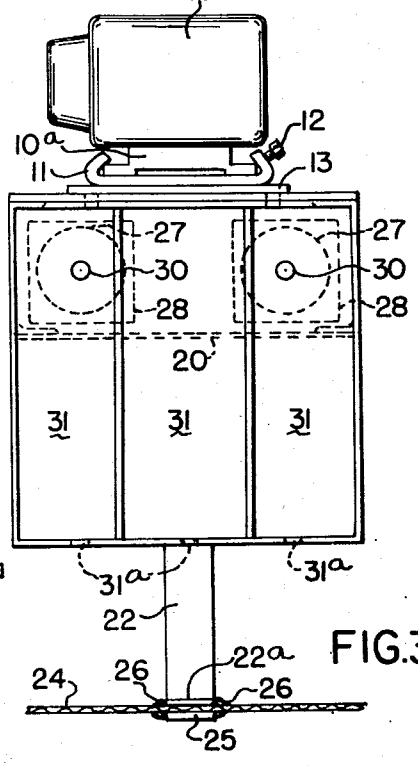
FIG. 3 is an end elevational view of FIG. 1.
Figure 1:
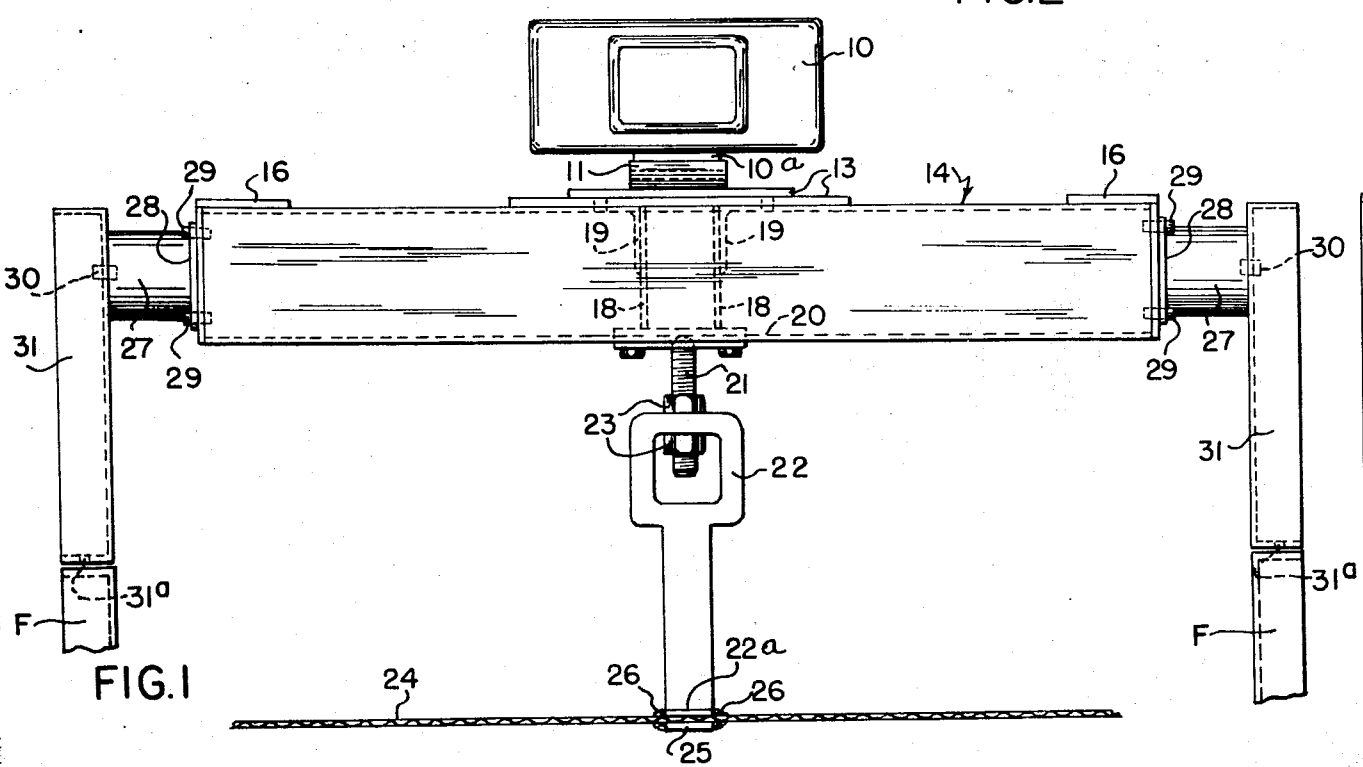
FIG. 1 is a side elevational view of one embodiment of the vibratory screen driving apparatus of this invention.

The equipment shown in FIGS. 1, 2 and 3 is provided either as a conversion kit for attachment in place of the vibrators of existing vibratory screening equipment, or it may be incorporated in newly produced equipment.

The vibratory screener arrangement of this invention is quieter than known electromagnetic powdered screener drives available on the market today. No housing covers are needed to encapsulate the drive to capture or deaden the noise. Typical noise levels of this unit in operation are less than 85 decibels on the "A" scale at 5 feet from the equipment.

The vibrator drive mechanism 10 is bolted right on top of the main cross beam assembly 14 for ease in maintenance. The only areas of maintenance in the entire assembly consists of periodic lubrication of the vibrator bearings. In the event of a malfunction of the vibrator 10, it is readily unbolted and lifted off. Typical vibrator replacement may be made in five to ten minutes.

The force outputs and amplitude of the vibrators 10 are readily altered by removing the end cover, or covers, loosening a single bolt holding pairs of eccentric weights, and repositioning such weights and tightening the bolt.

The lower cost of a rotary mechanical vibrator, as compared to tuned vibrator drive systems, makes the drive system of this invention more advantageous for equal force generation.

What is claimed is:

1. A mechanical vibratory screen drive for attachment to a screen mounted in a stationary main framework comprising a unitary motor driven mechanical vibrator; means for producing power to said vibrator; a vibrator mounting rigidly connected with said vibrator; a rigid cross beam structural assembly rigidly connected therewith and extending laterally substantially equally in opposite horizontal directions therefrom; a vibrator driving stud rigidly connected with said structural assembly directly beneath said vibrator; an attachment bracket rigidly connected with said driving stud and extending vertically downward therefrom; there being means at the lower end of said bracket adapted for rigid attachment to said screen only and at one location immediately below said bracket; vibration isolating means adapted to isolate the vibrator from the main screen support framework consisting of a plurality of rubber mounts; bracket means at opposite ends of said structural assembly; said structural assembly including a vertical plate, said bracket means being adapted to be rigidly attached to said main framework; said rubber mounts being firmly connected at opposite horizontal ends between the vertical plate of said structural assembly and said bracket means and providing the sole connection therebetween; whereby with the described parts so assembled and with power provided to said vibrator, said vibrator will supply effective vibration to said screen with little vibrator energy supplied to said screen supporting framework, the force of said vibrator drive provides a sharp and positive screening motion with sufficient power to overcome heavy screen loads on fine mesh screens, and widely varying loads on said screen will have little effect on the amplitude of screen vibration since it is not a tuned vibration system.

* * * * *